US012102888B2

(12) United States Patent
Hill et al.

(10) Patent No.: US 12,102,888 B2
(45) Date of Patent: Oct. 1, 2024

(54) PUTTER CLUB HEAD WITH PROFILED FACE INSERT

(71) Applicants: John L. Hill, West Springfield, MA (US); John P. Hill, San Diego, CA (US)

(72) Inventors: John L. Hill, West Springfield, MA (US); John P. Hill, San Diego, CA (US)

( * ) Notice: Subject to any disclaimer, the term of this patent is extended or adjusted under 35 U.S.C. 154(b) by 0 days.

(21) Appl. No.: 17/980,648

(22) Filed: Nov. 4, 2022

(65) Prior Publication Data

US 2023/0143221 A1 May 11, 2023

Related U.S. Application Data

(60) Provisional application No. 63/276,998, filed on Nov. 8, 2021.

(51) Int. Cl.
*A63B 53/04* (2015.01)

(52) U.S. Cl.
CPC ..... *A63B 53/042* (2020.08); *A63B 53/0408* (2020.08); *A63B 53/0487* (2013.01); *A63B 2209/00* (2013.01)

(58) Field of Classification Search
CPC ..... A63B 53/042; A63B 53/0408; A63B 53/0487; A63B 2209/00; A63B 53/0425; A63B 53/0429; A63B 53/0416; A63B 53/0458; A63B 53/0462; A63B 53/007
USPC ..... 473/340–341, 332, 342
See application file for complete search history.

(56) References Cited

U.S. PATENT DOCUMENTS

| | | | | |
|---|---|---|---|---|
| 1,562,956 | A * | 11/1925 | Guerne | A63B 53/0466 473/335 |
| 4,508,350 | A * | 4/1985 | Duclos | A63B 53/0487 473/254 |
| 5,078,398 | A | 1/1992 | Reed et al. | |
| 5,083,778 | A * | 1/1992 | Douglass | A63B 53/0487 473/329 |
| 5,100,146 | A * | 3/1992 | Antonious | A63B 53/0487 473/341 |
| 5,377,979 | A * | 1/1995 | Long | A63B 53/007 273/DIG. 8 |
| 5,405,136 | A | 4/1995 | Hardman | |
| 5,458,332 | A | 10/1995 | Fisher | |
| 5,485,997 | A | 1/1996 | Schmidt et al. | |
| 5,524,331 | A | 6/1996 | Pond | |

(Continued)

*Primary Examiner* — Sebastiano Passaniti
(74) *Attorney, Agent, or Firm* — Deborah A. Basile; T. D. Bomzer

(57) ABSTRACT

A golf club putter includes a head having an insert including face and base portions that interface with each other and are made of materials with dissimilar moduli of elasticity. The face portion can be a polymer and the base portion can be a metal. The face portion has a front facing surface that strikes the golf ball and an opposing rear surface with a smooth curved or stepped angled profile. The base portion has a front surface that interfaces with the rear surface of the face portion and is curved or stepped similar to the face portion. The front-to-back dimension of the face portion is thinnest at the center of the club head, and its thickness progressively increases as the curve of the rear surface of the face portion moves away from the club head center towards the heel and toe of the club head.

16 Claims, 4 Drawing Sheets

(56) References Cited

U.S. PATENT DOCUMENTS 5,575,472 A 11/1996 Magerman et al.
5,674,132 A 10/1997 Fisher
5,718,644 A * 2/1998 Donofrio ..... A63B 53/0487 473/340
5,766,093 A 6/1998 Rohrer
5,931,743 A 8/1999 Baker et al.
6,001,030 A * 12/1999 Delaney ..... A63B 53/0487 473/340
6,200,229 B1 * 3/2001 Grace ..... A63B 53/0487 473/409
6,217,460 B1 * 4/2001 Broadbridge ..... A63B 53/0487 273/DIG. 11
6,227,986 B1 * 5/2001 Fisher ..... A63B 53/0487 473/340
6,273,827 B1 * 8/2001 Hockerson ..... A63B 53/0487 473/340
6,273,831 B1 8/2001 Dewanjee
6,302,807 B1 * 10/2001 Rohrer ..... A63B 60/00 473/340
6,431,997 B1 * 8/2002 Rohrer ..... A63B 53/047 473/340
6,860,822 B2 * 3/2005 Vrska, Jr. ..... A63B 53/0487 473/340
7,115,041 B2 10/2006 Guard et al.
7,175,540 B2 * 2/2007 Sano ..... A63B 53/0487 473/340
7,309,296 B2 * 12/2007 Souza ..... A63B 53/0487 473/332
7,448,955 B2 * 11/2008 Bryant ..... A63B 53/0487 473/251
7,588,503 B2 9/2009 Roach et al.
7,824,278 B2 * 11/2010 Miyamichi ..... A63B 53/0487 473/340
8,292,754 B2 * 10/2012 Snyder ..... A63B 60/00 473/331
8,979,668 B2 * 3/2015 Nakamura ..... A63B 53/0487 473/340
9,943,735 B2 4/2018 Rife
10,245,476 B2 4/2019 Abbott et al.
10,322,324 B2 6/2019 Dolezel
10,456,634 B2 10/2019 Abbott et al.
10,456,638 B2 10/2019 Dolezel et al.
10,688,349 B2 6/2020 Stubben et al.
10,722,768 B1 7/2020 Yi et al.
10,737,153 B2 8/2020 Schweigert et al.
10,780,325 B2 9/2020 Abbott et al.
10,821,333 B2 11/2020 Stubben et al.
10,881,914 B2 1/2021 Hamburger
10,898,770 B2 1/2021 Matsunaga et al.
10,905,921 B1 2/2021 Stubben et al.
10,960,278 B2 3/2021 Serrano et al.
11,065,517 B2 7/2021 Taylor et al.
11,161,018 B2 11/2021 Stubben et al.
2003/0207724 A1 * 11/2003 Cameron ..... A63B 69/3614 473/340
2005/0020378 A1 * 1/2005 Krumme ..... A63B 53/04 473/340
2005/0054462 A1 3/2005 Breier et al.
2005/0130764 A1 * 6/2005 Frame ..... A63B 53/0487 473/340
2007/0021236 A1 * 1/2007 Tucker ..... A63B 53/06 473/340
2007/0099723 A1 * 5/2007 Tateno ..... A63B 53/0487 473/340
2007/0149311 A1 * 6/2007 Wright ..... A63B 53/0487 473/340
2012/0149492 A1 * 6/2012 Del Rosario ..... A63B 53/0487 473/340
2013/0005503 A1 * 1/2013 Kii ..... A63B 53/0487 473/340
2014/0148268 A1 * 5/2014 Hatton ..... A63B 53/065 473/325

* cited by examiner

PUTTER CLUB HEAD WITH PROFILED FACE INSERT

CROSS-REFERENCE TO RELATED APPLICATIONS

The present application claims the benefit of U.S. Provisional Patent Application No. 63/276,998, filed Nov. 8, 2021, the contents of which are incorporated by reference herein.

FIELD OF THE INVENTION

The subject matter disclosed herein relates in general to golf clubs, and more specifically to a putter type of golf club having a head portion that includes an insert comprising face and base portions made of dissimilar materials and which interface together at curved profiled surfaces to thereby provide for consistent golf ball distance traveled regardless of where on the putter club face the golf ball is hit.

BACKGROUND OF THE INVENTION

When using a putter type of golf club while playing golf, it is known for the golfer to attempt to strike the golf ball with the front face of the putter club head at the approximate center of gravity ("COG") of the club head. Oftentimes the COG of the putter club head is marked with a visual indicator so that the golfer knows where the COG is. This is to impart the desired amount of velocity to the ball in an attempt to get the ball to travel a desired distance and into the cup. However, oftentimes the ball is contacted or struck by the putter face unintentionally at other than or away from the COG or "sweet spot" of the club face (i.e., "off center" on the heel or toe portions of the club face). As such, a considerable lessening or drop off in the velocity of the golf ball occurs. This can occur, for example, when the golfer places the ball too close or too far from his/her body. This may also occur due to a curved arc instead of a straight back swing/takeaway and/or forward follow through swing, or from some other swing irregularity. Such an off-center hit has the negative effect of usually causing the golf ball to travel at a less than desired velocity and, thus, the ball does not travel the necessary distance for the ball to reach the cup. It may also cause the golf ball to travel in other than a desired direction towards the cup as the club head may undesirably turn or be torqued by the force of the golf ball being hit by the club head at a point away from the COG and at the heel or toe portions of the club head. The typical result is that the golfer fails to get the ball in to the cup as intended.

There are many known attempts to mitigate or solve the problem of decreased golf ball velocity or "speed drop-off" due to off-center hits and, thus, to enhance shot distance performance. These prior art attempts include, for example, use of inserts in the putter head, and variations in the texture of the surface of the putter face as well as variations in putter face material composition, thickness, and in the sizes of grooves formed in the putter face. Yet, it is known that relatively minor manufacturing variations in machining and/or quality control (which typically occur in the manufacturing process) may negate the benefits of groove variations and other ball distance performance features utilized in golf club putters.

Therefore, what is needed is an improved design of the head portion of a golf club putter and an associated improved golf club putter head manufacturing method, which together better solve the problem of decreased velocity of a golf ball when the ball undergoes an off-center hit by the putter head, thereby providing for consistent velocity and consistent resulting distance traveled of the golf ball regardless of where on the face of the putter head the ball is hit.

BRIEF SUMMARY OF THE INVENTION

An object of embodiments of the present invention is to provide a golf club putter head that improves ball striking distance performance by advantageously utilizing the principles of stored elastic potential energy along the entire length of the face of the putter head between the toe and heel of the putter head to thereby compensate or correct for off-center hits of the golf ball.

Another object of embodiments of the present invention is to provide a golf club putter head that provides for approximate equal velocity and, thus, equal distance of travel of the golf ball, by utilizing increased amounts of elasticity within the putter head starting with a minimum value of elasticity at the center of the head and increasing elasticity values along the entire length of the face of the putter head out towards the toe and heel of the putter head.

Still another object of embodiments of the present invention is to provide a golf club putter head that provides for approximate equal velocity and, thus, equal distance of travel of the golf ball regardless of where on the face of the club head the golf ball is hit, thereby providing for more consistent results when putting the golf ball.

Yet another object of embodiments of the present invention is to provide a novel improved head design for all current and known types of putter heads, including blade and mallet type putters and high moment of inertia ("MOI") putters, along with those putter types and putter head types to be designed and developed in the future.

Another object of embodiments of the present invention is to provide a golf club putter head that enhances the feel and sound to a user when the head strikes the ball.

Still another object of embodiments of the present invention is to provide a golf club putter head that provides for approximate equal distance of travel of the golf ball regardless of the existence of other performance features and characteristics included in the putter head, including weighting, types of materials utilized, and high MOI features.

According to exemplary embodiments of the present invention, a golf club putter head includes an insert located within the head, the insert comprising a face portion and a base portion that interface with each other and are made of dissimilar materials, each of the materials having a modulus of elasticity that differs relatively significantly from one another, the insert thus being considered a composite. The face portion preferably comprises a polymer and the base portion preferably comprises a metal, the polymer having a relatively much lower modulus of elasticity than that of the metal. The face portion is thus relatively much more elastic that the base portion. The face portion has a front facing surface which is used to strike the golf ball and an opposing rear surface with a relatively smooth radiused arc-shaped curved profile or a stepped angled profile. The base portion has a front surface that interfaces with the rear surface of the face portion. The front surface or the base portion is curved in a relatively smooth radiused profile or is angled in a stepped profile in a similar manner and amount as the rear surface of the face portion, to thereby facilitate the physical interfacing or attachment of the face portion to the base portion. The curve or angle of the rear surface of the face portion and that of the corresponding interfacing front surface of the base portion is such that the front-to-back dimension of the face portion is at its thinnest or least amount at the approximate COG of the club head, and the thickness progressively increases as the curve or angle of the rear surface of the face portion moves away from the COG in each direction towards the heel and toe of the club head.

BRIEF DESCRIPTION OF THE DRAWINGS

The subject matter, which is regarded as the disclosure herein of exemplary embodiments of the present invention, is particularly pointed out and distinctly claimed in the claims at the conclusion of this specification. The forgoing and other features and advantages of the present invention will become more apparent from the following detailed description taken in conjunction with the accompanying drawings in which:

DETAILED DESCRIPTION OF THE INVENTION

Figure 1:
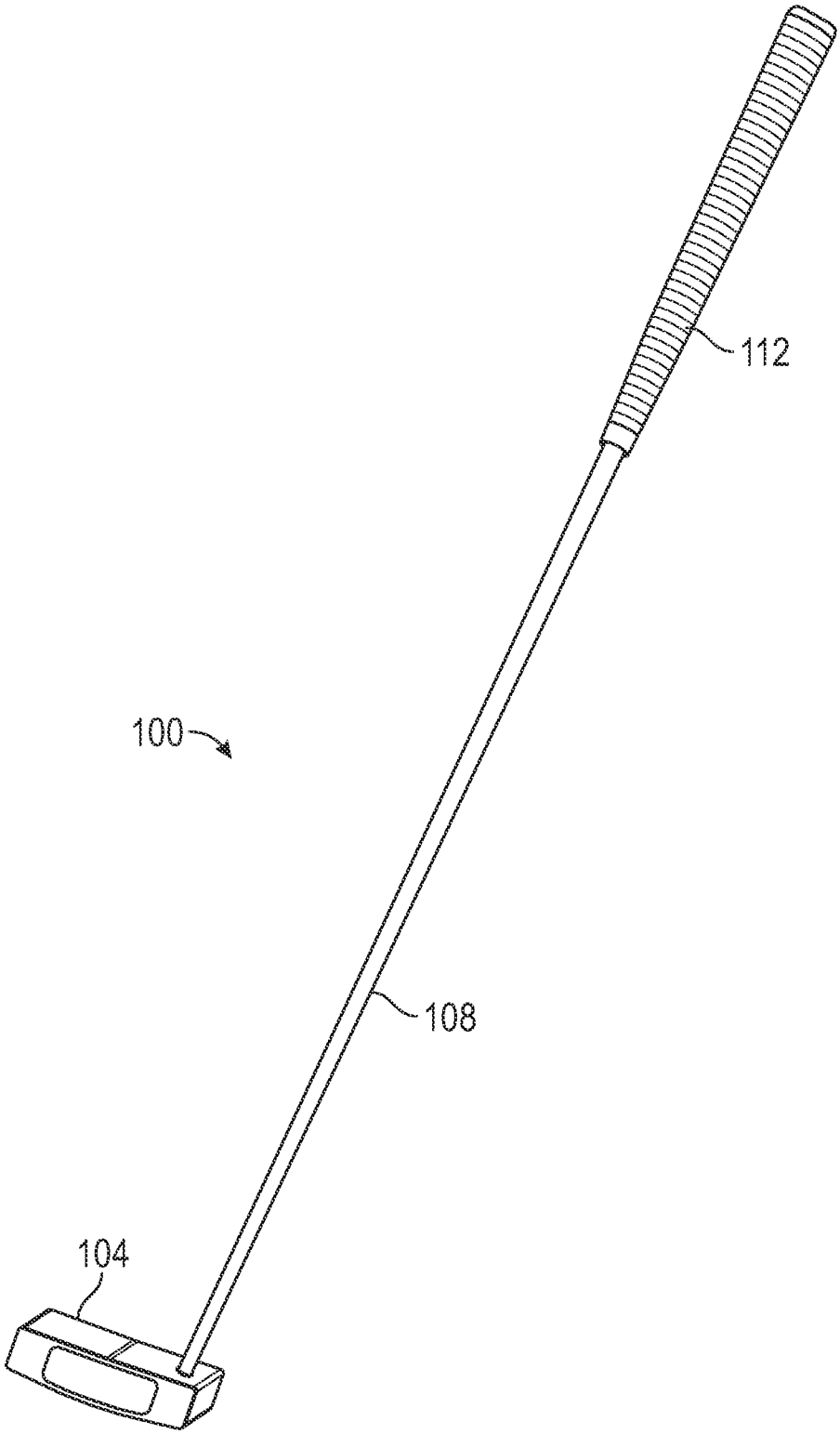
FIG. 1 is a perspective view of a putter type of golf club having a shaft, a grip, and a head containing an insert, according to exemplary embodiments of the present invention.
Figure 3:
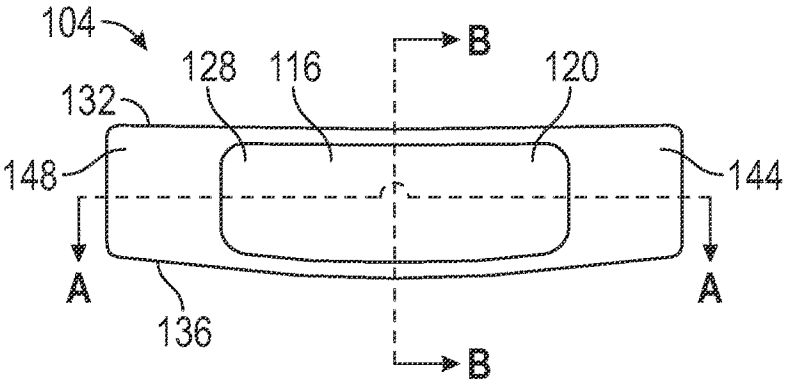
FIG. 3 is a front view of the putter head of FIG. 2, according to exemplary embodiments of the present invention.

It should be understood that throughout this patent application and specifically in the written description that follows and in the accompanying drawing figures, various directional and orientational terms such as horizontal, vertical, diagonal, up, down, upward, downward, in, out, inwards, outwards, forward, backward, front, rear, back, top, bottom, upper, lower, left, right, center, middle, and other similar directional and orientational terms as they are used herein refer to the golf club putter and the putter head of the various exemplary embodiments of the present invention as that putter and the head is oriented when typically in use or being held by someone. All these terms are used in this written description and in the drawings for convenience only and as an aid to better understanding the exemplary embodiments of the present invention. These terms are not intended to be limiting in the claims or to imply that the golf club putter or the putter head must be used or positioned in any particular or specific direction or orientation to satisfy the claims.

Referring to FIG. 1, there illustrated is a perspective view of a putter type of golf club 100 having a head 104, a shaft 108, and a grip 112. As exemplary embodiments of the present invention are located primarily in the putter head 104, the shaft 108 and the grip 112 form no part of the broadest scope of the present invention. As such, the shaft 108 and grip 112 may comprise conventional shapes and materials. Also, the putter head 104 may comprise any type of known putter head such as, for example and without limitation, a blade type, a mallet type, or a high moment of inertia ("MOI") type which itself may be a blade type or mallet type. The putter head 104 of exemplary embodiments of the present invention may also comprise future putter head designs. The material comprising the putter head 104 may be aluminum or other suitable metal, alloy, composite, or other types of materials.

Referring to FIGS. 2-5, the putter head 104 illustrated comprises a mallet type of putter head. In accordance with exemplary embodiments of the present invention, the putter head 104 includes an insert 116 located within or inside a forward or front portion of the putter head 104. The insert 116 comprises two separate components: a face portion 120 and a base portion 124, which are attached or bonded to one another typically by an adhesive (e.g., an aircraft or aerospace epoxy adhesive such as the Scotch-Weld® EC-2216 B/A commercially available from 3M®). The face portion 120 has a front facing surface 128 at the front of the putter head 104 which is normally used to strike the golf ball.

The putter head 104 also includes a top surface 132 and an opposing bottom surface 136. The top surface 132 may have formed therein a hole 140 into which a lower hosel portion of the shaft 108 of the putter 100 is inserted and fixed in place using e.g., an adhesive. However, it should be understood that the shaft 108 may connect with the putter head 104 at any location on or within the head 104, as is known in the art. The location where the shaft 108 connects with the putter head 104 forms no part of the broadest scope of the present invention. Further, the portion of the putter head 104 farthest from the person using the putter 100 is typically referred to as the toe portion 144, while the portion of the head 104 closest to the person using the putter 100 is typically referred to as the heel portion 148. The toe portion 144 and the heel portion 148 thus define a horizontal lengthwise distance across the front facing surface 128 of the face portion 120.

The mallet type putter head 104 also includes a back portion having a pair of holes 156, 160 into which weights (not shown) may be disposed. The weights may comprise a suitable material such as tungsten used to provide a desired weighting for the putter head 104. Such weighting is known to be used, for example, to increase the moment of inertia of the putter head 104 to thereby increase the resistance of the putter head 104 to any twisting or torquing of the head 104 when the person using the putter 100 strikes the ball at other than the COG of the head 104 (i.e., at the toe portion 144 or the heel portion 148). Nevertheless, it is to be understood that such putter head weighting forms no part of the broadest scope of the present invention.

Also, while the top surface 132 of the putter head 104 may be straight, the bottom surface or "sole" 136 of the head 104 may be angled or radiused upwards slightly (e.g., 5 degrees). This angling may begin at or near the COG and proceed outward towards both the toe portion 144 and the heel portion 148, as is known in the art to improve the ball striking performance of the putter head 104. However, the bottom surface 136 of the putter head 104 may be straight similarly to the top surface 132.

Figure 5:
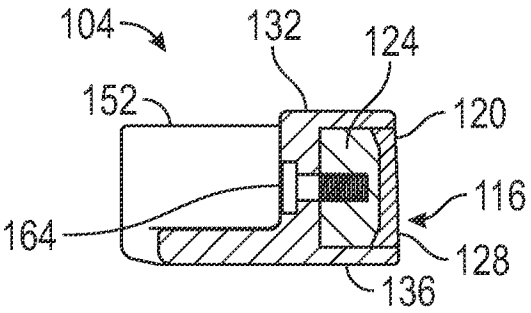
FIG. 5 is a side cross-sectional view of the putter head of FIG. 2 taken along lines B-B of FIG. 3, according to exemplary embodiments of the present invention.
Figure 2:
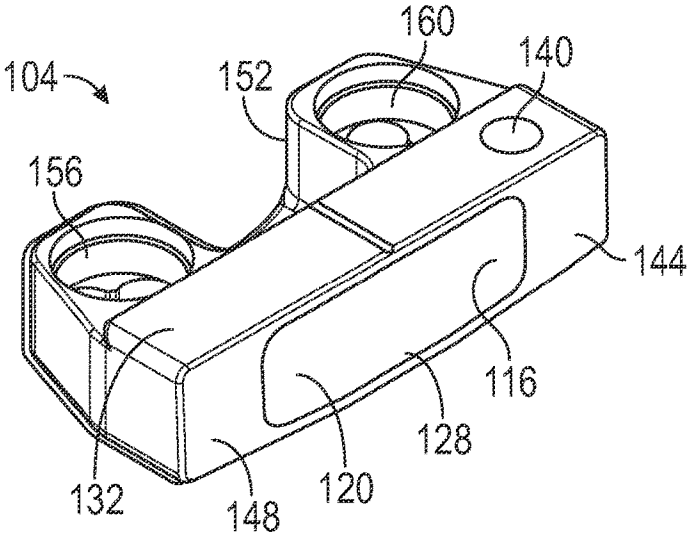
FIG. 2 is a perspective view of the putter head of FIG. 1, according to exemplary embodiments of the present invention.
Figure 4:
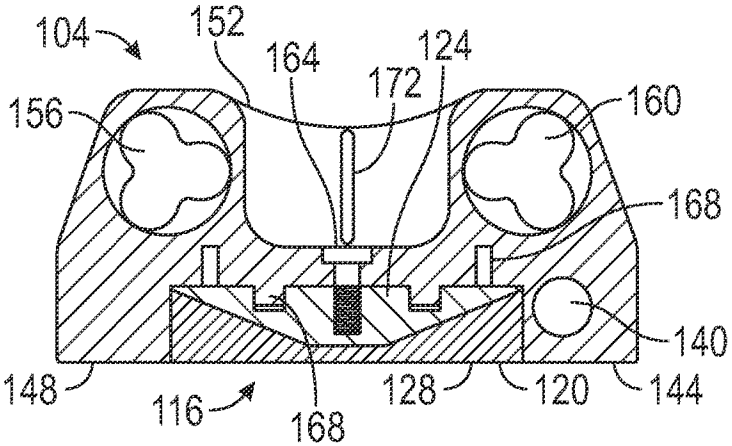
FIG. 4 is a top cross-sectional view of the putter head of FIG. 2 taken along lines A-A of FIG. 3, according to exemplary embodiments of the present invention.
Figure 7:
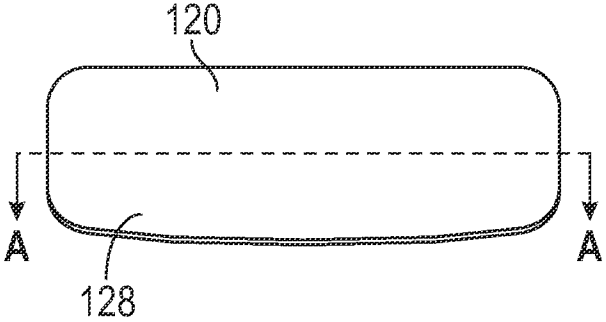
FIG. 7 is a front view of the face portion of the insert of FIG. 6, according to exemplary embodiments of the present invention.
Figure 9:
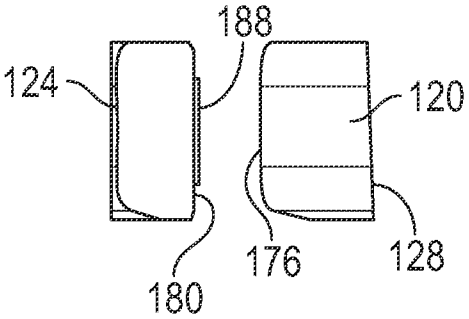
FIG. 9 is a side view of the face portion and the base portion of the insert of FIG. 6, according to exemplary embodiments of the present invention.
Figure 10:
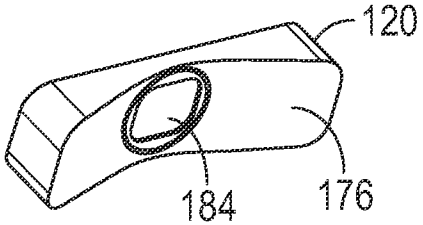
FIG. 10 is a perspective rear view of the face portion of the insert of FIG. 6, according to exemplary embodiments of the present invention.
Figure 6:
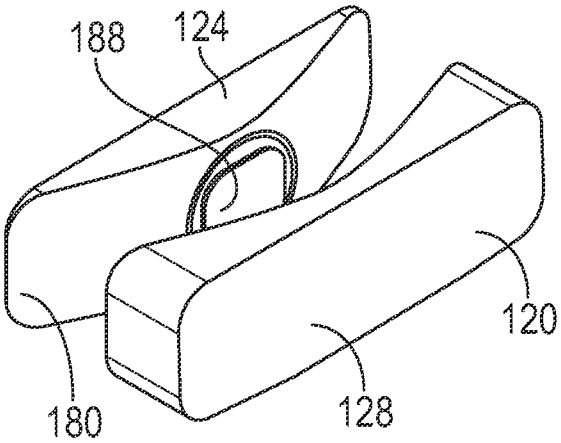
FIG. 6 is a perspective view of a face portion and a base portion of an insert within the putter head of FIG. 2, the face portion and the base portion shown separated from one another, according to exemplary embodiments of the present invention.

FIGS. 4 and 5 also illustrate the rear portion 152 of the putter head 104 having an insert mounting screw 164 placed within a hole in the rear portion 152 and threaded into the back portion 124 of the insert 116. The screw 164 may be used to attach the insert 116 to the putter head 104. However, other means for attaching the insert 116 to the putter head 104 may be utilized such as, e.g., an adhesive.

One or more physical alignment features 168 may be formed in the putter head 104 and the back portion 124 of the insert 116 to assist with the proper placement and location of the insert 116 within the head 104 during assembly of the putter head 104. These features 168 may include depressions and/or protrusions appropriately formed. The rear portion 152 of the putter head may also include a visual alignment aid 172 (e.g., a straight line) which is typically used to assist the person using the putter 100 to properly line up the putter head 104 with the golf ball to thereby establish a target direction for the ball towards the cup.

As best seen in FIG. 4, according to exemplary embodiments of the present invention, the face portion 120 of the insert 116 has a varying thickness as viewed from front to back (i.e., from the facing surface 128 towards the back portion 152) and extending along a length of the head 104 between the toe and heel portions 144, 148 of the head 104. More specifically, the face portion 116 has its relatively thinnest portion at its approximate center when viewed as such in FIG. 4, which may correspond, but not necessarily, to the approximate COG of the putter head 104. The location of the COG of the putter head 104 depends on various physical characteristics of the head 104 such as its shape and weight. Also, according to exemplary embodiments of the present invention, the thickness of the face portion 116 increases outwards from the COG in each direction towards the toe portion 144 and towards the heel portion 148.

Although not marked as such in the figures, oftentimes the COG of the putter club head 104 is marked with a visual indicator so that the golfer knows where the COG is to assist the golfer in striking the golf ball. Alternatively, the center of the face portion 120, and not necessarily the COG of the clubhead 104, may have a visual indicator (not shown) to assist the golfer in striking the golf ball.

In a similar manner, the base portion 124 of the insert 116 has its thickest portion at its center and the thickness of the base portion 124 decreases outwards in each direction towards the toe portion 144 and towards the heel portion 148. This is so that the thickness profile of the base portion 124 inversely matches the thickness profile of the face portion 120. As such, the insert 116 has a resulting generally rectangular overall shape when viewed in FIG. 4.

Additional details of the face portion 120 and the base portion 124 of the insert 116 are described and illustrated in more detail hereinafter and with reference to FIGS. 6-10. As described hereinabove and in accordance with exemplary embodiments of the present invention, the thickness of the face portion 120 varies in a specific manner and is thinnest at its center and is progressively thicker outwards in each direction towards the toe and heel portions 144, 148 of the putter head 104.

Also, according to exemplary embodiments of the present invention, the face portion 120 and the base portion 124 preferably comprise or are made of dissimilar materials, with each of the materials having a modulus of elasticity (i.e., an amount of elastic deformation) that differs relatively significantly from one another. More specifically, the face portion 120 comprises a material that is relatively much more elastic or less stiff than that of the base portion 124. This allows for a relatively large amount of elastic potential energy to be stored (and a correspondingly resulting large amount of kinetic energy to be released) when the putter head 104 strikes the golf ball. The striking of the golf ball by the putter head 104 is normally a purely elastic collision, due to the nature of the materials comprising the putter head 104 and the golf ball. As such, the insert 116 may be considered a composite.

The use of such dissimilar modulus of elasticity materials for the face portion 120 and the base portion 124 of the insert 116 within the putter head 104, together with the varying thickness profile of the face portion 120 of the insert 116, creates a putter head 104 that results in approximate equal velocity of the golf ball, and approximate equal distance of travel of the golf ball, regardless of where on the face 128 of the club head 104 the golf ball is hit.

In exemplary embodiments, the face portion 120 comprises a polymer while the base portion 124 comprises a metal, the polymer inherently having a relatively much lower modulus of elasticity than that of the metal, thereby making the face portion 120 much more elastic than the base portion 124. Polymers typically have a modulus of elasticity of approximately less than 5.0 GPa (gigapascals), while metals typically have a modulus of elasticity of approximately 200 GPa for steel. Also, the modulus of elasticity for polymers is typically in a range of value, whereas for metals the modulus of elasticity usually does not vary in a range. Thus, for purposes of exemplary embodiments of the present invention, the material comprising the face portion 120 may have a modulus of elasticity of less than 5.0 GPa, while the material comprising the base portion 124 may have a modulus of elasticity of approximately 200.0 GPa.

Suitable polymers for the face portion 120 may include for example and without limitation: (1) Polyethersulfone ("PES") having an average value of GPa of 2.55; (2) high-heat Polycarbonate ("PC", average GPa=2.35); (3) low-friction Acetal ("POM", average GPA=2.4); (4) Polyphenylene Ether ("PPE", average GPa=2.45); (5) impact-modified PPE (average GPa=2.45); (6) flame-retardant PPE (average GPa=2.45); (7) Acrylonitrile Butadiene Styrene ("ABS", average GPa=2.495); (8) impact-modified Polymethylmethacrylate/Acrylic ("PMMA", average GPa=2.5); (9) Polypropylene ("PP", average GPa=2.5); (10) flame-retardant ABS (average GPa=2.5); (11) Polybutylene Terephthalate ("PBT", average GPa=2.5); (12) flame-retardant Acrylonitrile Styrene Acrylate/Polycarbonate Blend ("ASA/PC", average GPa=2.5); (13) Polysulfone ("PSU", average GPa=2.6); (14) Polyimide ("PI", average GPa=2.65); (15) Ethylene Vinyl Alcohol ("EVOH", average GPa=2.7); (16) Styrene Maleic Anhydride ("SMA", average GPa=2.7); (17) Styrene Methyl Methacrylate ("SMMA", average GPa=2.75); (18) flame-retardant ABS/PC (average GPa=2.8); and (19) Chlorinated Polyvinyl Chloride ("CPVC", average GPa=2.85).

Suitable metals for the base portion 124 may include for example and without limitation: (1) 303 stainless steel (193 GPa); (2) nickel (210 GPa); 93) steel (200 GPa); and (4) stainless steel (196 GPa).

However, it should be understood by one of ordinary skill in the art that the face portion 120 does not necessarily need to comprise a polymer for the broadest scope of the present invention. Instead, the face portion 120 may comprise other suitable materials, depending in part upon the value of their modulus of elasticity, to achieve the desired consistent golf ball speed or velocity results regardless of the exact location on the face portion 120 the golf ball is struck.

In a similar manner, the base portion 124 does not necessarily need to comprise a metal or a metal alloy for the broadest scope of the present invention. Instead, the base portion 124 may comprise other suitable materials, depending upon their modulus of elasticity and their performance characteristics when interfacing with the material of the face portion 120.

To elaborate further, the materials comprising the face portion 120 and the base portion 124 may be chosen based on their engineered behavior such as, for example, their mass and density characteristics, and their stored elastic potential energy characteristics. It is known that the amount of stored elastic potential energy differs between thinner and thicker geometries of the materials chosen for the face and base portions 120, 124, along with the amount of stress loading in the toe portion 144 and in the heel portion 148 of the head putter 104.

Referring to FIGS. 6-10, the face portion 120 has a rear surface 176 which attaches to a front surface 180 of the base portion 124. As mentioned hereinabove, these surfaces 176, 180 may be bonded together using an adhesive, such as the aforementioned adhesive commercially available from 3M®. In addition, to aid in the proper alignment or placement of the face portion 120 with respect to the base portion 124 during the bonding process, an alignment feature 184 may be provided on the rear surface 176 of the face portion 120. A similar alignment feature 188 may be provided on the front surface 180 of the base portion 124. These alignment features 184, 188 may comprise a corresponding protrusion and mating depression, or similar alignment aids, formed in the surfaces 176, 180. As illustrated in FIGS. 6-10, the approximate shape of the alignment features 184, 188 is a square with rounded corners. However, the shape of these features 184, 188 can be any suitable shape. It is to be understood that the alignment features 184, 188 and their shapes form no part of the broadest scope of the present invention.

Although not shown, the facing surface 128 of the face portion 120 may have one or more grooves formed therein as is known to improve the accuracy of the putter head 104 when striking the golf ball. The grooves may comprise various shapes, sizes, and/or patterns, such as, e.g., straight or curved lines, or geometric or honeycomb patterns. It is to be understood that the grooves form no part of the broadest scope of the present invention.

Figure 8:
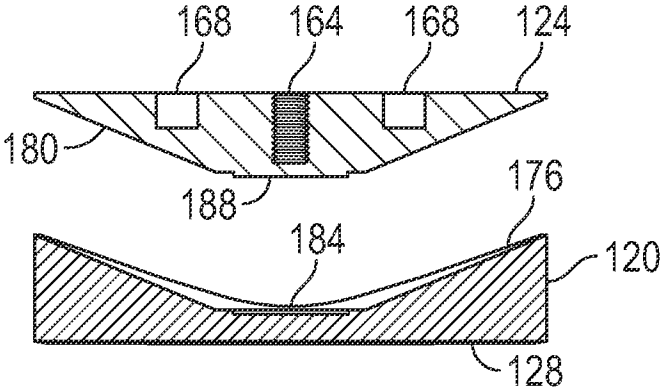
FIG. 8 is a top cross-sectional view of the face portion and the base portion of the insert of FIG. 6 taken along lines A-A of FIG. 7, according to exemplary embodiments of the present invention.

In addition, it can be seen in FIG. 8 that the front facing surface 128 of the face portion 120 may be angled upward slightly (e.g., 2 degrees of "loft") as is known in the art to improve the ball striking capability of the putter head 104. Also, similar to the angled bottom surface or sole 136 of the putter head 104 described hereinabove and illustrated in FIG. 3, a bottom surface of both the face portion 120 and the base portion 124 may be angled upward slightly at, e.g., 5 degrees. Further, as best seen in FIG. 8, the rear surface 176 of the face portion 120 may be angled upward slightly. As a consequence, the front surface 180 of the base portion 124 may be angled downward slightly in an equal amount.

As best seen in FIGS. 6-10, the rear surface 176 of the face portion 120 and the front surface 180 of the base portion 124 each has a radiused profile that is curved, arc-shaped or conical about the center point of the face portion 120 and the base portion 124, respectively. Also, the curvature of each surface 176, 180 is relatively smooth and continuous. This is to facilitate the varying value of the modulus of elasticity of the face portion 120. However, the curvature of each surface 176, 180 may not be entirely smooth, and instead may be stepped, as described hereinafter and illustrated in FIGS. 11 and 12.

Also, in an exemplary embodiment, the radius of the conical curvature of the surface 176 about its center is approximately 22 degrees. As such, the radius of the conical curvature of the surface 180 about its center is approximately 158 degrees. However, these amounts of curvature are purely exemplary. It should be apparent to one of ordinary skill in the art that other amounts of curvature may be used.

Figure 11:
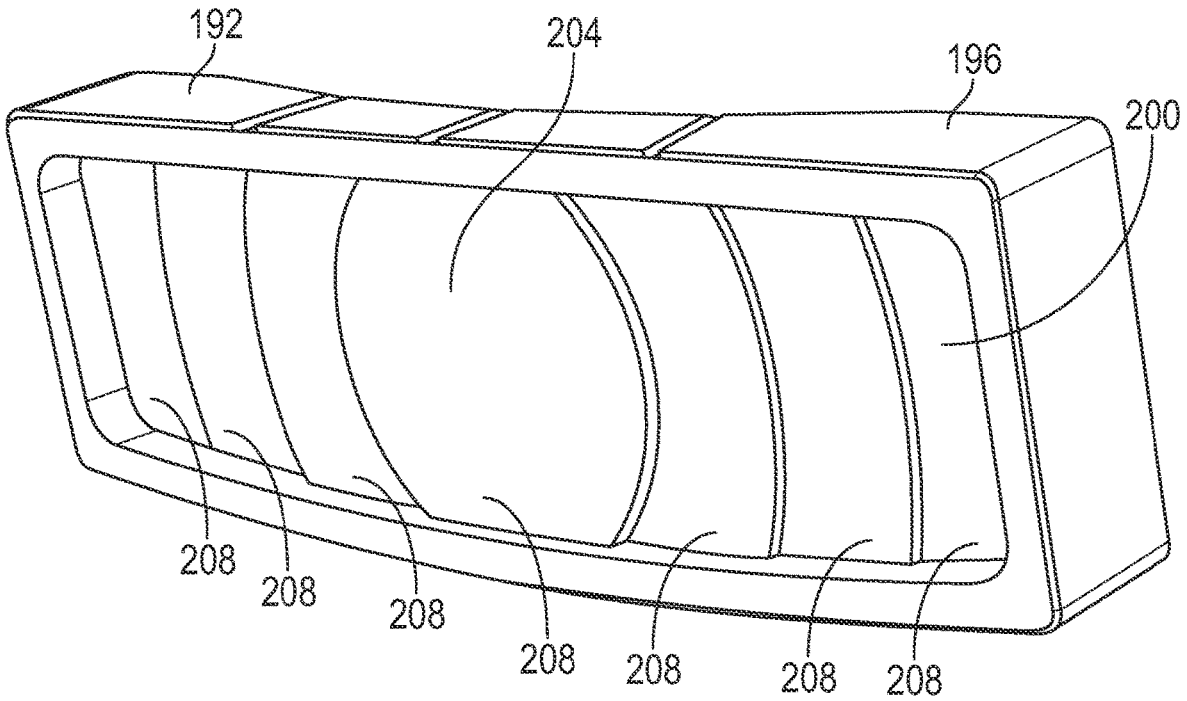
FIG. 11 is a perspective front view of an alternative embodiment of putter head having a pocket, according to exemplary embodiments of the present invention.
Figure 12:
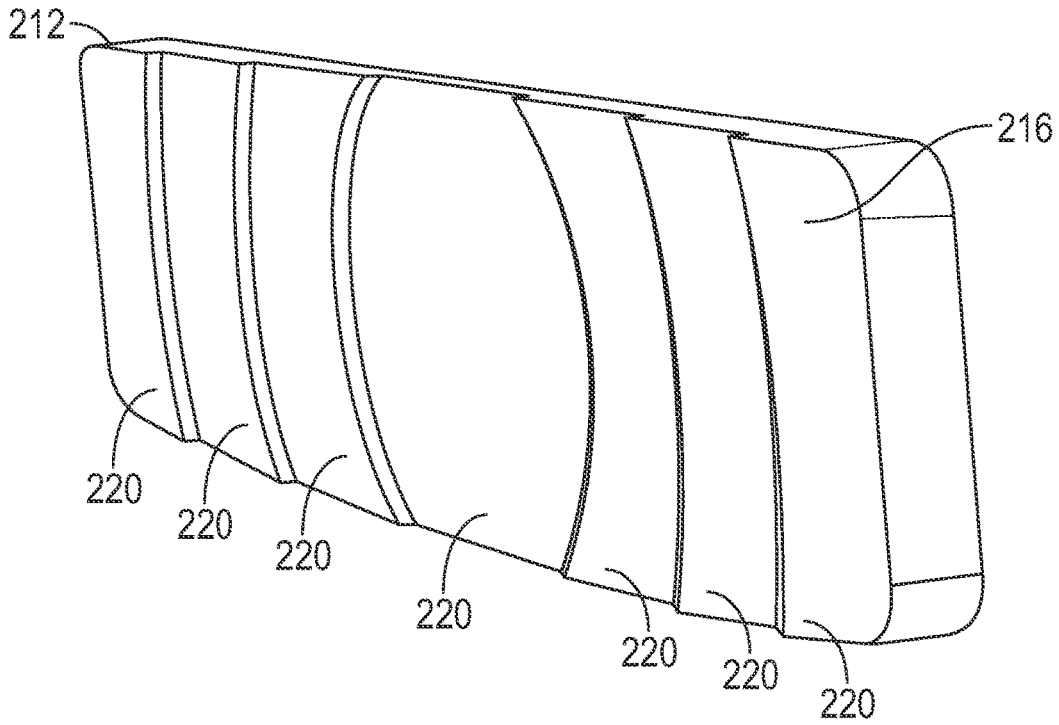
FIG. 12 is a perspective rear view of an alternative embodiment of a face insert disposed within the pocket of FIG. 11, according to exemplary embodiments of the present invention.

Referring to FIGS. 11 and 12, there illustrated is an alternative embodiment of a head 192 of a putter 100. In this embodiment, the head 192 comprises a body 196 having a recess or pocket 200 formed therein. The pocket 200 has a front facing surface 204 which, in this embodiment, has a plurality of discrete steps 208 formed therein. The front facing surface 204 has a desired radius of curvature or profile formed therein, similar to the smooth continuous curvature or profile of the front surface 180 of the base portion 124 described hereinabove and illustrated in FIGS. 6 and 8. The front facing surface 204 and the plurality of steps 208 may be formed directly into the pocket 200. In the alternative, a base insert having the steps 208 formed on a front face thereof may be disposed within the pocket 200.

FIG. 12 illustrates a front insert 212 having a rear surface 216 with a plurality of steps 220 formed therein. In this alternative embodiment, the front insert 212 is placed into the pocket 200 of the putter head 192 and secured therein with, e.g., an adhesive. As such, the front insert 212 is constrained laterally within the pocket 200. The amount of curvature of the rear surface 216 of the front insert 212 may equal or approximate the amount of curvature of front facing surface 204 of the pocket 200.

Similar to the embodiments of FIGS. 2-10 described hereinabove, the front facing surface 204 of the pocket 200 and the rear surface 216 of the front insert 212 may both extend horizontally lengthwise to a desired extent across the putter head 192 between a toe portion and a heel portion. The extension length of the front facing surface 204 of the pocket 200 and the rear surface 216 of the front insert 212 may depend on the desired performance characteristics of the putter head 192 and may also depend on other features and characteristics of the putter head (e.g., type of putter head, weight of putter head).

The face portion 120 of the insert 116 and the base portion 124 of the insert 116 may be manufactured in a variety of ways, including machining, injection molding, casting, pouring, and other methods now known or hereafter developed.

The terminology used herein is for the sole purpose of only describing particular exemplary embodiments of the invention and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, components, integers, steps, operations, and/or groups thereof.

While the invention is provided in detail in connection with only a limited number of embodiments, it should be readily understood that the invention is not limited to such disclosed embodiments. Rather, the invention can be modified to incorporate any number of variations, alterations, substitutions, or equivalent arrangements not heretofore described, but which are commensurate with the spirit and scope of the invention. Additionally, while various exemplary embodiments of the invention have been described, it is to be understood that these exemplary embodiments may include only some of the described exemplary aspects. Accordingly, the invention it not to be seen as limited by the foregoing description but is only to be limited by the scope of the appended claims.

The invention claimed is:

1. A club head of a putter-type golf club, comprising:

a front portion and a rear portion, spaced apart from each other in a thickness direction; a toe portion and a heel portion, spaced apart from each other along a length direction; and a top surface and a bottom surface, spaced apart from each other in a height direction, wherein the front portion defines a pocket; and an insert located within the pocket defined in the front portion of the club head, the insert having a face portion and a base portion, wherein:

the insert has a rectangular overall shape; and the pocket has a shape that inversely matches the overall shape of the insert;

the face portion and the base portion each have: a front surface and a rear surface, spaced apart from each other in the thickness direction; a top surface and a bottom surface, spaced apart from each other in the height direction; a first end and a second end, spaced apart from each other in the length direction; a center defined lengthwise between the first and second ends and height-wise between the top and bottom surfaces;

the rear surface of the face portion is attached to the front surface of the base portion and the rear surface of the base portion is attached to the club head within the pocket, so that the face portion is connected to the club head via the base portion, and the front facing surface of the face portion is flush with the front portion of the club head, whereby the insert forms a composite structure;

the face portion comprises a material having a first modulus of elasticity value of less than 5.0 gigapascals, and the base portion comprises a material having a second modulus of elasticity value of approximately 200.0 gigapascals, so that the face portion is more elastic than the base portion;

the club head is formed of a material that is more elastic than the face portion and less elastic than the base portion;

the rear surface of the face portion is conically shaped such that a thickness of the face portion increases from the center of the face portion toward the first and second ends of the face portion and out towards each of the top and bottom surfaces of the face portion, so that the thickness of the face portion is at a smallest value at the center of the face portion, between the toe portion and the heel portion of the club head;

the front surface of the base portion is conically shaped to receive the rear surface of the face portion and has a thickness profile that inversely matches a thickness profile of the face portion, such that a thickness of the base portion is at a largest value at the center of the base portion and decreases from the center of the base portion and out towards each of the first and second ends of the base portion and out towards each of the top and bottom surfaces of the base portion.

2. The putter head of claim 1, wherein a curvature of the rear surface of the face portion and a curvature of the front surface of the base portion are stepped, wherein each step is defined by an arcuate shaped edge having a center of curvature at the center location of respective ones of the face portion and the base portion.

3. The club head of claim 1, wherein the face portion is formed of a polymer.

4. The club head of claim 1, wherein the base portion is formed of a metal.

5. The club head of claim 1, wherein the material of the face portion is from the group including:

Polyethersulfone ("PES"); high-heat Polycarbonate ("PC"); low-friction Acetal ("POM"); Polyphenylene Ether ("PPE"); impact-modified PPE; flame-retardant PPE; Acrylonitrile Butadiene Styrene ("ABS"); impact-modified Polymethylmethacrylate/Acrylic ("PMMA"); Polypropylene ("PP"); flame-retardant ABS; Polybutylene Terephthalate ("PBT"); flame-retardant Acrylonitrile Styrene Acrylate/Polycarbonate Blend ("ASA/PC"); Polysulfone ("PSU"); Polyimide ("PI"); Ethylene Vinyl Alcohol ("EVOH"); Styrene Maleic Anhydride ("SMA"); Styrene Methyl Methacrylate ("SMMA"); flame-retardant ABS/PC; or Chlorinated Polyvinyl Chloride ("CPVC").

6. The club head of claim 1, wherein a material of the base portion is from the group including: stainless steel; nickel; steel; or stainless steel.

7. The club head of claim 1, wherein:

the rear surface of the face portion includes a first alignment guide;

the front surface of the base portion includes a second alignment guide; and the first and second alignment guides are configured to be attached to each other when the rear surface of the face portion is attached to the front surface of the base portion.

8. The club head of claim 1, wherein the rear surface of the face portion is attached to the front surface of the base portion by an adhesive.

9. The club head of claim 1, wherein the rear surface of the base portion is attached to the club head by a screw or an adhesive.

10. The club head of claim 1, wherein the center of the face portion, between the toe portion and the heel portion of the club head corresponds to a center of gravity of the club head.

11. The club head of claim 1, wherein the club head further includes one or more weights configured to affect a moment of inertia of the club head when the club head is striking a golf ball.

12. The club head of claim 1, wherein:

the front surface of the face portion is configured to strike a golf ball; and the front surface of the face portion is angled upwards towards the top surface of the face portion.

13. The club head of claim 1, wherein the face portion and the base portion are manufactured by a method from the group including: machining; injection molding; casting; or pouring.

14. The club head of claim 1, wherein the club head is one of: a blade-type club head; or a mallet-type club head.

15. A golf club comprising:

the club head of claim 1;

a shaft connected with the club head; and a grip connected with the shaft.

16. The club head of claim 1, wherein the club head is formed of aluminum.

* * * * *